United States Patent [19]

Malloy et al.

[11] Patent Number: 4,459,186

[45] Date of Patent: Jul. 10, 1984

[54] ELECTROCHEMICAL OXIDATION OF ALKYL AROMATIC COMPOUNDS

[75] Inventors: Thomas P. Malloy, Lake Zurich, Ill.; Mark A. Halter, Columbia, Md.; David W. House, Arlington Heights, Ill.

[73] Assignee: UOP Inc., Des Plains, Ill.

[21] Appl. No.: 412,403

[22] Filed: Aug. 27, 1982

Related U.S. Application Data

[63] Continuation-in-part of Ser. No. 234,516, Feb. 13, 1981, Pat. No. 4,354,904, which is a continuation-in-part of Ser. No. 61,210, Jul. 27, 1979, abandoned.

[51] Int. Cl.[3] ..... C25B 3/02

[52] U.S. Cl. ..... 204/59 R

[58] Field of Search ..... 204/59 R

[56] References Cited

U.S. PATENT DOCUMENTS 4,148,696 4/1979 Halter ..... 204/59 R

FOREIGN PATENT DOCUMENTS 2547383 4/1977 Fed. Rep. of Germany .... 204/59 R

*Primary Examiner*—Howard S. Williams

*Attorney, Agent, or Firm*—James R. Hoatson, Jr.; Raymond H. Nelson; William H. Page, II

[57] ABSTRACT

Aromatic ketones may be prepared by subjecting an alkyl aromatic compound containing more than one carbon atom in the alkyl substituent to an electrical energy which includes a direct electrical current in the presence of a nucleophile such as an organometallic oxide, a solvent and a reaction initiator such as an alkali metal hydroxide and a quaternary ammonium hydroxide to produce a ketal, following which the ketal may be converted to the desired ketone by hydrolysis.

12 Claims, No Drawings

ELECTROCHEMICAL OXIDATION OF ALKYL AROMATIC COMPOUNDS

CROSS-REFERENCE TO RELATED APPLICATIONS

This application is a continuation-in-part of our copending application, Ser. No. 234,516 filed Feb. 13, 1981, and issued as U.S. Pat. No. 4,354,904 on Oct. 19, 1982, which is a continuation-in-part of application, Ser. No. 61,210 filed July 27, 1979, and now abandoned, all teachings of which are incorporated herein by reference thereto.

BACKGROUND OF THE INVENTION

Aromatic ketones which may be used in a variety of chemical reactions have been prepared by various alternate reactions. For example, one method of preparing an aromatic ketone is by a Friedel Crafts acylation reaction in which benzene and an acyl chloride such as acetyl chloride or propionyl chloride are reacted in the presence of a Friedel Crafts catalyst such as aluminum chloride, boron trifluoride, etc. Another method of preparing an aromatic ketone has been an air oxidation reaction in an oxygen-enriched environment utilizing a transition metal catalyst such as cupric bromide at relatively high temperatures and pressures. Likewise, aromatic ketones may be synthesized by the chemical oxidation of the substrate using stoichiometric quantities of electrochemically generated oxidants such as salts of cobalt, manganese or chromium in their highest valence state in a strongly acidic medium at elevated temperatures. The reduced oxidant is then recycled, purified and electrolytically reoxidized back to its active state.

The inherent drawback in the last named reaction involves the reoxidation and recycling of the oxidant by electrochemical methods. Heretofore, all of the methods which have been employed in this area have oxidized the transition metal to its higher valence state prior to combination of the same with the organic substrate in a conventional chemical reactor. In essence, this comprises a two-step reaction which requires both an electrochemical reactor and a chemical reactor. In addition, the aforementioned processes have utilized relatively concentrated acids such as from 40% to 70% concentration of sulfuric acid or perchloric acid, thus making the selectivities of these processes for activated alkyl aromatic systems less than desirable. The undesirability of these processes results from the tendency of the alkyl aromatic systems towards sulfonation or by-product formation.

Prior work in the oxidation of aromatic compounds has been shown in U.S. Pat. No. 4,046,652. However, this patent describes the oxidation of an aromatic nucleus in an electrochemical reaction to form p-benzoquinone diketals. The electrolyte which is used in this electrochemical reaction comprises methyl alcohol containing a conducting salt, preferably an ammonium or alkali metal salt of an acid such as hydrofluoric acid, perchloric acid, nitric acid, etc. Likewise, U.S. Pat. No. 4,148,696 also relates to electrochemical oxidation reactions involving aromatic compounds. However, this patent involves an anodic acyloxylation involving the use of a salt of a fatty acid. Another patent, namely U.S. Pat. No. 4,101,392 discloses a process for the electrolytic oxidation of aromatic compounds. However, this patent is concerned with a process for the methylmethyl coupling of hydroxy aromatic compounds, which process is in contradistinction to the process of the present invention, hereinafter set forth in greater detail, which is concerned with the oxidation of the methyl substituent of a methyl-substituted aromatic compound. An article which appeared in the *Bulletin of the Chemical Society of Japan,* volume 37, number 11, has disclosed an electrochemical process for the methoxylation of aromatic compounds. This anodic oxidation was effected by treating an aromatic compound such as tetralin, indane, or diphenylmethane, to afford a methoxy-substituted aromatic compound. However, this process is dissimilar from the process of the present invention in which an alkyl-substituted aromatic compound is converted to a ketone at the benzylic carbon atom.

U.S. Pat. No. 4,284,825 teaches the preparation of a 4-substituted benzaldehyde-dialkylacetal by the electrochemical oxidation of a 4-substituted methylbenzene using an electrolyte consisting of an alcohol which contains a conductive salt. However, in contradistinction to this process, as will hereinafter be set forth in greater detail, it has now been discovered that the oxidation of alkyl aromatic compounds in which the alkyl substituent contains at least 2 carbon atoms in an electrochemical reaction may be effected in an electrolyte which includes the presence of a nucleophile of the type later set forth to form an intermediate compound which may then be converted to the desired ketone.

DETAILED DESCRIPTION OF THE INVENTION

This invention relates to a process for the electrochemical oxidation of an alkyl aromatic compound. More specifically, the invention is concerned with a novel electrosynthetic process to form aromatic carbonyl compounds such as aromatic ketones.

Ketones which have been formed by the oxidation of certain alkyl aromatic compounds will find a wide variety of uses in the chemical field. For example, acetophenone (phenylmethylketone) is used in perfumes, colognes, etc.; as an intermediate for pharmaceuticals, resins; as a solvent and, by chlorinating the compounds, as a tear gas. Propiophenone (phenylethylketone) is used as a fixative in perfumes or colognes, as the starting material for the synthesis of ephedrine and several other pharmaceuticals, as a raw material for the preparation of numerous synthetic organic chemicals, etc. Likewise, diacetyl benzene may be used as a photo initiator.

It is therefore an object of this invention to provide a process for the aromatic oxidation of alkyl aromatic compounds.

A further object of this invention is to provide a novel electrosynthetic route to oxidize alkyl aromatic compounds to form ketals which are then converted to the desired ketones.

In one aspect an embodiment of this invention is found in a process for the preparation of an aromatic ketone which comprises subjecting an alkyl-substituted aromatic compound in which said alkyl substituent contains more than one carbon atom to an electrical energy including direct electric current in an electrochemical cell in the presence of a nucleophile selected from the group consisting essentially of an organometallic oxide having the generic formula:

R—O—M in which R is either an alkyl or aryl moiety and M is an alkali metal selected from the group consisting of sodium, lithium and potassium, a carboxylate and a halide, in the presence of a solvent consisting essentially of an aliphatic alcohol, an aliphatic diol, a ketone or mixtures thereof, and in the presence of a reaction initiator selected from the group consisting of an alkali metal hydroxide and a quaternary ammonium hydroxide at reaction conditions to produce an intermediate compound and thereafter subjecting said intermediate compound to hydrolysis to produce the resultant aromatic ketone which is recovered.

A specific embodiment of this invention is found in a process for the preparation of an aromatic ketone which comprises subjecting ethylbenzene to an electrical energy which includes a direct current having a voltage in the range of from about 2 to about 30 volts at a current density in the range of from above 0 to about 1000 milliamps per square centimeter in a medium comprising methyl alcohol in the presence of a nucleophile comprising sodium methoxide and a reaction initiator comprising sodium hydroxide, said treatment being effected in an electrochemical cell at a temperature in the range of from about ambient to about 50° C. and atmospheric pressure to form the resultant alpha, alpha-dimethylketal of ethylbenzene, thereafter subjecting said ketal to acid hydrolysis and recovering the desired acetophenone.

Other objects and embodiments will be found in the following further detailed description of the invention.

DETAILED DESCRIPTION OF THE INVENTION

As hereinbefore set forth, the present invention is concerned with a novel electrosynthetic route to form aromatic carbonyl compounds such as aromatic ketones by the electrochemical oxidation of an alkyl aromatic compound, the alkyl moiety of said compound containing more than one carbon atom in the chain. The electrosynthesis of an alkyl aromatic compound of the type hereinafter set forth in greater detail involves the anodic benzyl carbon atom oxidation of the compound in the presence of a nucleophile to form an intermediate compound. Following the formation of the intermediate compound, the compound may then be subjected to further treatment such as subsequent acid hydrolysis procedure in order to obtain the desired carbonyl compound such as a ketone. The electrochemical oxidation is effected in an electrochemical cell which may be a divided electrical cell using suitably chosen electrodes and an environmentally suitable anion expansion membrane or, if so desired, it may also be effected in a standard electrolytic cell which is not divided.

By utilizing the process of the present invention, it is possible to effect the desired reaction in a process which requires only product separation with no need for concurrent electrolyte purification, thus utilizing a significantly less corrosive and industrially feasible method with the concurrent advantages of low by-product formation and lower overall processing costs.

The alkyl aromatic compounds which are used by the electrochemical process of this invention will include those compounds having the generic formula:

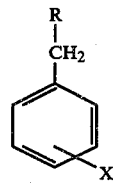

in which R may be an alkyl substituent containing from 1 to about 9 carbon atoms, and X may be selected from the group consisting of hydrogen, alkyl, alkoxy, hydroxy, primary amine, secondary amine and tertiary amine substituents. Some specific examples of these compounds which may be employed as starting materials will include-o-hydroxyethylbenzene, m-hydroxyethylbenzene, p-hydroxyethylbenzene, o-methoxyethylbenzene, m-methoxyethylbenzene, p-methoxyethylbenzene, o-ethoxyethylbenzene, m-ethoxyethylbenzene, p-ethoxyethylbenzene, o-propoxyethylbenzene, m-propoxyethylbenzene, p-propoxyethylbenzene o-butoxyethylbenzene, m-butoxyethylbenzene, p-butoxyethylbenzene, 1,2-diethylbenzene, 1,3-diethylbenzene, 1,4-diethylbenzene, 2-propylethylbenzene, 3-propylethylbenzene, 4-propylethylbenzene, 2-t-butylethylbenzene, 3-t-butylethylbenzene, 4-t-butylethylbenzene, 2-hydroxyethylnaphthalene, 3-hydroxyethylnaphthalene, 4-hydroxyethylnaphthalene, 2-methoxyethylnaphthalene, 3-methylethylnaphthalene, 4-methylethylnaphthalene, 2-ethoxyethylnaphthalene, 3-ethoxyethylnaphthalene, 4-ethoxyethylnaphthalene, 2-propoxyethylnaphthalene, 3-propoxyethylnaphthalene, 1,2-diethylnaphthalene, 1,3-diethylnaphthalene, 1,4-diethylnaphthalene, 2-propylethylnaphthalene, 3-propylethylnaphthalene, 4-propylethylnaphthalene, o-ethylaniline, m-ethylaniline, p-ethylaniline, o-n-butylaniline, m-n-butylaniline, p-n-butylaniline, o-ethyl-N-methylaniline, m-ethyl-N-methylaniline, p-ethyl-N-methylaniline, o-ethyl-N,N-dimethylaniline, m-ethyl-N,N-dimethylaniline, p-ethyl-N,N-dimethylaniline, o-ethyl-N,N-diethylaniline, m-ethyl-N,N-diethylaniline, p-ethyl-N,N-diethylaniline, o-benzylethylbenzene, m-benzylethylbenzene, p-benzylethylbenzene, 1,2-di-N-propylbenzene, 1,3-di-N-propylbenzene, 1,4-di-N-propylbenzene, 1,2-di-N-butylbenzene, 1,3-di-N-butylbenzene, 1,4-di-N-butylbenzene, 1,2-di-N-pentylbenzene, 1,3-di-N-pentylbenzene, 1,4-di-N-pentylbenzene, the corresponding n-hexyl, n-heptyl, n-octyl, n-nonyl and n-decyl benzenes, etc. It is to be understood that the aforementioned alkyl-substituted aromatic compounds which contain from 2 to about 10 carbon atoms in the alkyl substituent on the ring are only representative of the class of compounds which may be employed and that the present invention is not necessarily limited thereto.

The electrochemical oxidation of the aforementioned alkyl-substituted aromatic containing at least one benzylmethylene group is accomplished by subjecting said compounds to an electrical energy which includes direct electrical current in the presence of a nucleophile to form intermediate compounds, these compounds then being subsequently subjected to acid hydrolysis to form the desired ketone. In the preferred embodiment of the invention, the nucleophiles which are employed to effect the desired reaction will include organometallic oxides in which the metallic portion of the compound preferably comprises an alkali metal. Some specific examples of nucleophiles which may be employed in the present invention will possess the generic formula R—O—M in which R may be an alkyl or aryl group and M is a metal, preferably an alkali metal such as sodium methoxide, sodium ethoxide, sodium isopropoxide, sodium t-butoxide, sodium sec-pentoxide, sodium phenoxide, sodium-2-phenylethoxide, sodium-3-phenylpropoxide, sodium-4-phenylbutoxide, sodium-5-phenylpentoxide, lithium methoxide, lithium ethoxide, lithium isopropoxide, lithium t-butoxide, lithium sec-pentoxide, lithium benzoate, lithium phenoate, lithium-2-phenylethoxide, lithium-3-phenylpropoxide, lithium-4-phenylbutoxide, lithium-5-phenylpentoxide, potassium methoxide, potassium ethoxide, potassium isopropoxide, potassium t-butoxide, potassium sec-pentoxide, potassium phenoxide, potassium-2-phenylethoxide, potassium-3-phenylpropoxide, potassium-4-phenylbutoxide, potassium-5-phenylpentoxide, etc., the intermediate compounds which are formed when utilizing this type of nucleophile being a ketal. It is also contemplated within the scope of this invention that other nucleophiles may also be employed such as carboxylates and halides. Specific examples of carboxylates which may be used will include sodium acetate, sodium propionate, sodium butylate, sodium benzoate, potassium acetate, potassium propionate, potassium butylate, potassium benzoate, lithium acetate, ltihium propionate, lithium butylate, lithium benzoate, etc., the intermediate compound which is formed when utilizing these nucleophiles comprising a diester of the alkyl-substituted aromatic compound. Specific examples of halides which may be employed will include sodium chloride, sodium bromide, sodium iodide, sodium fluoride, potassium chloride, potassium bromide, potassium iodide, potassium fluoride, rubidium chloride, rubidium bromide, rubidium iodide, rubidium fluoride, etc., the intermediate compounds which are formed when utilizing these nucleophiles being dihalides of the alkyl-substituted aromatic compound.

In addition to the nucleophile, the anodic benzyl oxidation is effected in the presence of a solvent including aliphatic mono- and diols such as methyl alcohol, ethyl alcohol, n-propyl alcohol, isopropyl alcohol, n-butyl alcohol, t-butyl alcohol, ethylene glycol, propylene glycol, etc.

If so desired, the reaction medium may also include a reaction initiator or phase transfer agent which will decrease the lag time of the reaction. Suitable examples of these reaction initiators or phase transfer agents which may be employed will include alkali metal oxides such as sodium hydroxide, potassium hydroxide, lithium hydroxide, rubidium hydroxide, cesium hydroxide, etc., quaternary ammonium hydroxides, both symmetrical and asymmetrical in nature, such as tetramethylammonium hydroxide, tetrapropylammonium hydroxide, trimethylbenzylammonium hydroxide, dimethyldibenzylammonium hydroxide, methyltribenzylammonium hydroxide, triethylbenzylammonium hydroxide, diethyldibenzylammonium hydroxide, ethyltribenzylammonium hydroxide, etc., quaternary phosphonium hydroxides such as tetramethylphosphonium hydroxide, tetraethylphosphonium hydroxide, tetrapropylphosphonium hydroxide, etc., tetramethylammoniumperchlorate, tetraethylammoniumperchlorate, tetrapropylammoniumperchlorate, tetramethylammoniumtetrafluoroborate, tetraethylammoniumtetrafluoroborate, tetrapropylammoniumtetrafluoroborate, etc. The reaction initiators or phase transfer agents hereinbefore enumerated will act as a supporting electrolyte in order to increase the conductivity of the medium as well as decreasing the overall operating costs of the reaction.

The electrochemical cell in which the electrochemical oxidation of the alkyl aromatic compound is effected may be of any variety which is well known in the art. The electrodes which are employed in the cell may be formed of any conductive material such as a carbon anode and stainless steel cathode, a ruthenized titanium dioxide base anode and a copper cathode, a platinum anode and stainless steel cathode, etc., although it is also contemplated that other conductive materials may be employed. The oxidation reaction is effected utilizing an electrical energy which includes a voltage within the range of from about 2 to about 30 volts at a current density in the range of from about 0 to about 1000 milliamps/cm$^2$.

The process may be effected in any suitable manner and may comprise either a batch or continuous type operation. When a batch type operation is employed, the electrolyte solution is added to a reservoir along with the particular alkyl aromatic compound which is to undergo electrochemical oxidation. The cell is then subjected to an electrical energy within the range hereinbefore set forth for a predetermined period of time which may range from about 0.5 up to about 10 hours or more in duration. In addition, it is also contemplated within the scope of this invention that the electrochemical cell which is employed to effect the process may comprise a divided cell using an environmentally stable anion exchange membrane to separate the two reservoirs, one reservoir containing the anolyte and the other reservoir containing the catholyte. The anolyte solution containing the alkyl aromatic compound which is to undergo electrochemical oxidation is placed in one reservoir and the catholyte is placed in the second reservoir. When utilizing either a divided electrochemical cell or an undivided electrochemical cell, the reaction mixture after completion of the desired residence time is withdrawn and subjected to conventional means of separation which may include decantation, washing, drying, fractional distillation, etc., whereby the desired product comprising a ketal, a diester or a dihalide, depending upon the particular nucleophile employed, may be separated from unreacted starting materials and recovered.

The intermediate compound such as the ketal, diester or dihalide which has been recovered from the prior step is then subjected to an acid hydrolysis step which will convert this compound to the desired ketone. The acid hydrolysis is effected by subjecting the product to treatment with an acidic compound at hydrolysis conditions which will include atmospheric pressure and a temperature which may range from about ambient (20°–25° C.) up to about 75° C. The hydrolysis is effected in an appropriate apparatus utilizing, in the preferred embodiment of the invention, a mineral acid such as hydrochloric acid, nitric acid, sulfuric acid, dilute sulfuric acid, or relatively strong organic acids such as formic acid, acetic acid, propionic acid, butyric acid, benzoic acid, etc. It is also contemplated within the scope of this invention that the acid hydrolysis may also be effected utilizing an ion exchange resin such as the Amberlyst resins which are in hydrogen ion form.

Following the treatment of the aforesaid intermediate compound for a period of time which may range from about 0.5 to about 10 hours or more in duration, the desired ketonic product is separated by conventional means from the acid and/or any unreacted starting materials, and recovered.

It is also contemplated within the scope of this invention that the process may be effected in a continuous manner of operation. When such a type of operation is employed, the reaction mixture comprising alkyl aromatic compounds of the type hereinbefore set forth, and if so desired, a co-solvent and a reaction initiator may be continuously charged to an electrochemical cell which is maintained at the proper operating conditions of temperature and pressure. After cycling through the cell and being subjected to an electrical charge for a predetermined period of time, the effluent is continuously withdrawn and subjected to conventional means of separation similar to those hereinbefore set forth whereby the desired product comprising the ketal, diester or dihalide is recovered, while any unreacted alkyl aromatic compounds as well as other components of the medium are recycled.

The intermediate compound which is recovered from the above step is continuously charged to a vessel which will contain an acidic compound of the type hereinbefore set forth in greater detail, said vessel being maintained at the proper operating conditions of temperature and pressure. After contact with the acidic compound for a predetermined period of time, the reactant effluent is continuously withdrawn and subjected to conventional means of separation whereby the desired ketonic compound is separated from the acid component of the reaction mixture and recovered, while the aforementioned acidic compound and any unreacted intermediate compound is recycled to the reaction zone.

The following examples are given for purposes of illustrating the process of the present invention for the preparation of aromatic ketones. However, it is to be understood that these examples are given merely for purposes of illustration and that the present invention is not necessarily limited thereto.

EXAMPLE I

To prepare an alkyl aromatic ketone, a reaction mixture comprising 90 grams of methanol, 4 grams of sodium methoxide which contains a minor amount of sodium hydroxide to form a basic medium along with 20 grams of ethylbenzene may be placed in a reservoir of an electrochemical cell. The electrochemical cell which may be utilized for the electrochemical oxidation reaction may have a surface area of about 50 square centimeters utilizing a copper cathode and a platinum anode, the electrodes being spaced at a distance of about 13.0 mm. The solution may be subjected to an electrical energy which may range from about 7.0 to about 9.0 volts at 2.0 amps. The reaction may be allowed to proceed for a period of about 4 hours following which the alpha-alpha-dimethyl ketal of ethylbenzene may be recovered.

The dimethyl ketal may then be converted to the desired ketone by admixing equal quantities of the ketal and an aqueous solution of hydrochloric acid in an appropriate flask at reaction conditions which may include ambient temperature and atmospheric pressure. The conversion may be allowed to proceed for a predetermined period of time following which the aqueous layer and the organic layer may be separated utilizing a separatory funnel and the desired acetophenone may be recovered therefrom.

EXAMPLE II

In a manner similar to that set forth in Example I above, 90 grams of methyl alcohol along with 11 grams of potassium methoxide, which may contain a minor amount of potassium hydroxide, and 25 grams of n-propyl benzene may be placed in an electrochemical cell similar in nature to that set forth in Example I above. The reaction mixture may then be subjected to an electrical energy ranging from about 9.5 to about 12.0 volts at 2.0 amps for a period of 6 hours. At the end of the 6 hour period, the system may be drained, rinsed with methyl alcohol and admixed with an equal amount of an aqueous nitric acid solution. The conversion of the alpha-alpha-dimethyl ketal of propyl benzene is allowed to proceed at ambient temperature and atmospheric pressure for a period of 4 hours. At the end of the 4 hour period, the aqueous layer and the organic layer may again be separated by means of a separatory funnel and the desired propiophenone recovered therefrom.

EXAMPLE III

In this example, 100 grams of ethyl alcohol along with 10 grams of sodium ethoxide which contains a minor amount of sodium hydroxide and 25 grams of p-diethylbenzene may be treated in an electrochemical cell of similar dimensions to those hereinbefore set forth using an anode comprising a titanium dioxide/ruthenium dioxide DSA electrode and a copper cathode. The electrical energy which may be supplied to the cell may range from about 9.0 to about 12.0 volts at 2.0 amps. After subjecting the solution to the electrical energy for a period of about 20 hours, the diketal may be recovered and converted to the desired ketone by treatment with an ion-exchange resin, sold under the trade name Amberlyst 15, in a flask, the conversion being effected at ambient temperature and atmospheric pressure. After a reaction period of 1 hour, separation may be effected by means of a separatory funnel and the desired p-diacetylbenzene may be separated from the aqueous phase.

We claim as our invention:

1. A process for the preparation of an aromatic ketone which comprises subjecting an alkyl-substituted aromatic compound in accordance with the following structure:

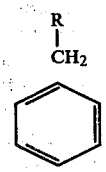

wherein R is an alkyl substituent containing from 1 to about 9 carbon atoms to direct electric current in an electrochemical cell in the presence of a nucleophile in accordance with the following structure:

R—O—M wherein R is an alkyl or aryl moiety and M is an alkali metal selected from the group consisting of sodium, lithium and potassium in the presence of a solvent consisting essentially of an aliphatic alcohol, an aliphatic diol, a ketone or mixtures thereof, and in the presence of an alkali metal hydroxide initiator at a temperature in the range of ambient to 50° C. to produce a ketal intermediate compound and thereafter subjecting said intermediate compound to hydrolysis to produce said aromatic ketone.

2. The process as set forth in claim 1 in which said electrical energy includes a voltage in the range of from about 2 to about 30 volts at a current density in the range of from above 0 to about 1000 milliamps per square centimeter.

3. The process as set forth in claim 1 in which said reaction conditions include atmospheric pressure.

4. The process as set forth in claim 1 in which said alkali metal hydroxide reaction initiator is sodium hydroxide.

5. The process as set forth in claim 1 in which said alkali metal hydroxide reaction initiator is potassium hydroxide.

6. The process as set forth in claim 1 in which said nucleophile is sodium methoxide.

7. The process as set forth in claim 1 in which said nucleophile is potassium methoxide.

8. The process as set forth in claim 1 in which said aliphatic alcohol solvent is methyl alcohol.

9. The process as set forth in claim 1 in which said aliphatic alcohol solvent is ethyl alcohol.

10. The process as set forth in claim 1 in which said alkyl-substituted aromatic compound is ethylbenzene, said nucleophile is sodium methoxide and said aromatic ketone is acetophenone.

11. The process as set forth in claim 1 in which said alkyl-substituted aromatic compound is n-propylbenzene, said nucleophile is potassium methoxide and said aromatic ketone is propiophenone.

12. The process as set forth in claim 1 in which said alkyl-substituted aromatic compound is p-diethylbenzene, said nucleophile is sodium methoxide, and said aromatic ketone is p-diacetylbenzene.

* * * * *